United States Patent [19]

Brooks et al.

[11] Patent Number: 4,582,981

[45] Date of Patent: Apr. 15, 1986

[54] GLOW PLUG HAVING A RESISTIVE SURFACE FILM HEATER

[75] Inventors: Mark A. Brooks, Sterling Heights, Mich.; Donald A. Grimes, Findlay; Fred E. Heischman, Fostoria, both of Ohio

[73] Assignee: Allied Corporation

[21] Appl. No.: 701,642

[22] Filed: Feb. 13, 1985

Related U.S. Application Data

[63] Continuation of Ser. No. 507,254, Jun. 23, 1983, abandoned.

[51] Int. Cl.[4] ..... F23Q 7/22

[52] U.S. Cl. ..... 219/270; 123/145 A; 123/145 R; 219/541; 361/266

[58] Field of Search ..... 219/260, 267, 270, 390, 219/497, 535, 522, 541, 543, 544, 553; 123/145 R, 145 A, 272; 29/620, 611; 361/264, 265, 266; 338/240, 241, 309, 326, 327, 328, 330; 431/262

[56] References Cited

U.S. PATENT DOCUMENTS

| | | | |
|---|---|---|---|
| 2,198,850 | 4/1940 | White | 123/145 A |
| 3,553,833 | 1/1971 | Jochim et al. | 29/611 |
| 4,035,613 | 7/1977 | Sagawa et al. | 219/522 |
| 4,183,136 | 1/1980 | Colla | 29/620 |
| 4,268,954 | 5/1981 | Sease et al. | 29/620 |
| 4,302,659 | 11/1981 | Horiba et al. | 219/270 |
| 4,322,604 | 3/1982 | Kawamura et al. | 219/497 |
| 4,345,142 | 8/1982 | Dietz | 219/390 |
| 4,345,555 | 8/1982 | Oshima et al. | 123/272 |
| 4,357,526 | 11/1982 | Yamamoto et al. | 219/544 |
| 4,418,661 | 12/1983 | Esper et al. | 123/145 A |
| 4,437,440 | 3/1984 | Suzuki et al. | 123/145 A |

FOREIGN PATENT DOCUMENTS

| | | | |
|---|---|---|---|
| 489225 | 1/1919 | France | 123/145 A |
| 2398969 | 2/1979 | France . | |
| 86805 | 1/1956 | Norway | 123/145 A |
| 225186 | 1/1925 | United Kingdom . | |
| 1094522 | 12/1967 | United Kingdom . | |
| 2092670 | 8/1982 | United Kingdom . | |

*Primary Examiner*—Volodymyr Y. Mayewsky
*Attorney, Agent, or Firm*—James R. Ignatowski; Russel C. Wells

[57] ABSTRACT

A glow plug having a hollow cylindrical metal shell, an axial electrical terminal, and a heater member protruding externally from the shell. The heater member has a surface film heater element disposed on at least one surface of an electrically nonconductive cylindrical substrate. Electrical connections between the heater element, the shell and the axial electrode are made by conductive surface films. A first conductive surface film disposed on the external surface of the cylindrical substrate makes electrical contact with the shell. A second conductive surface film disposed on the internal surface of the cylindrical substrate makes electrical contact with the axial electrical terminal. The heating element is preferably a transition metal surface film which catalytically reacts with the air/fuel mixture to enhance combustion at lower temperatures. The thermal response time of the surface film heater element from ambient to an operating temperature exceeding 800° C. is less than 5 seconds.

53 Claims, 5 Drawing Figures

Fig-5
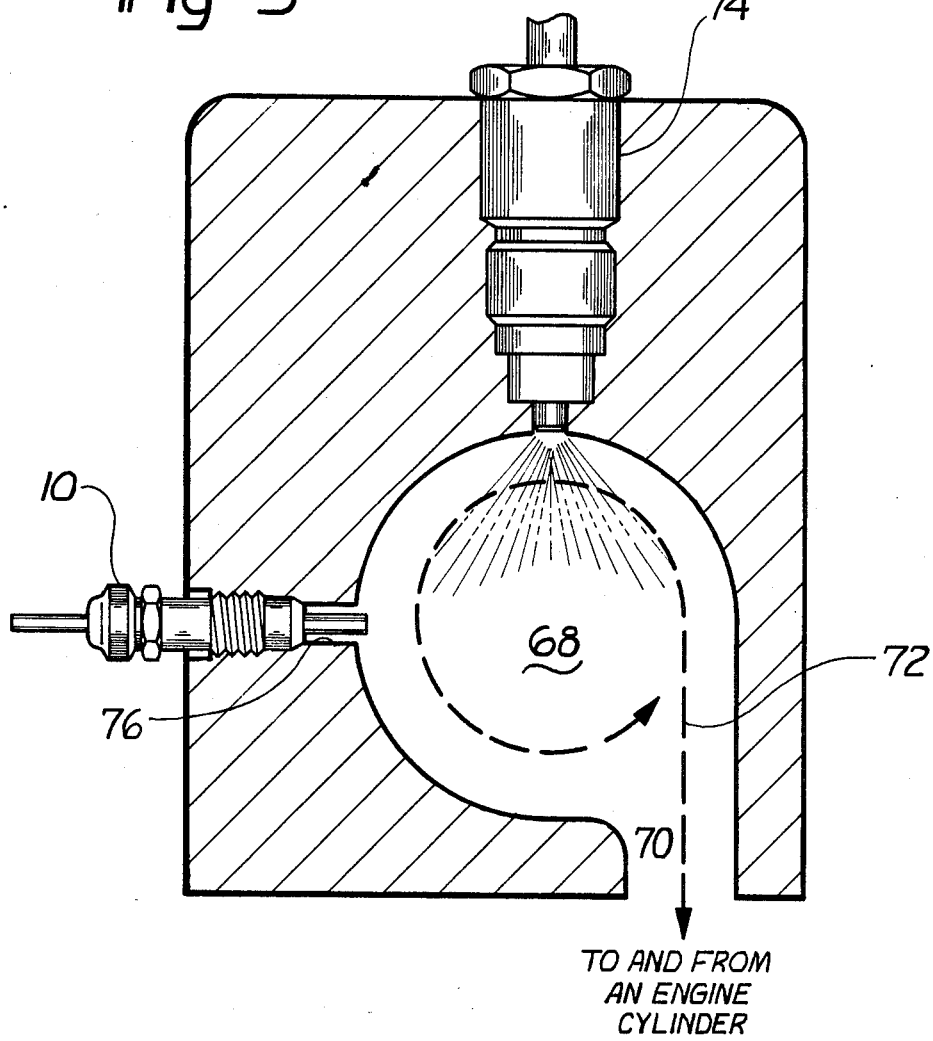
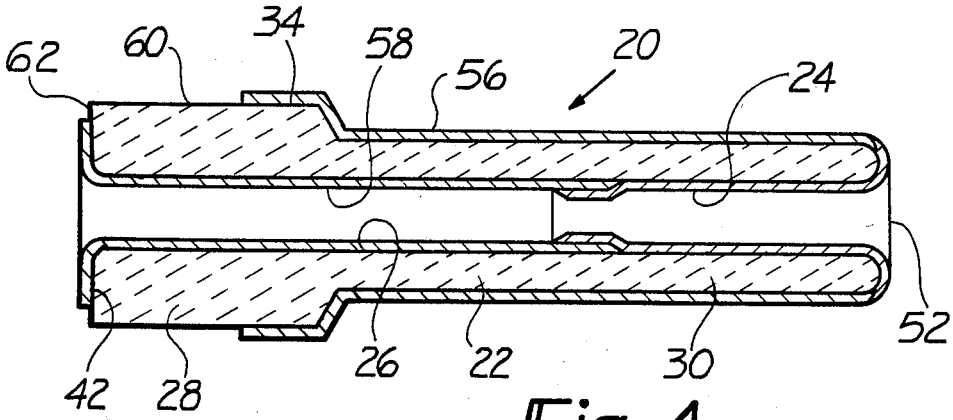
Fig-4

GLOW PLUG HAVING A RESISTIVE SURFACE FILM HEATER

This application is a continuation of application Ser. No. 507,254, filed June 23, 1983, now abandoned.

CROSS REFERENCE

The invention is an improved embodiment of the glow plug described in co-pending commonly-assigned patent application, Ser. No. 430,909 entitled "A Glow Plug Having A Conductive Film Heater" filed Sept. 30, 1982.

BACKGROUND OF THE INVENTION

1. Field of the Invention

The invention is related to the field of electric heaters for the ignition of hydrocarbon fuels and in particular to glow plugs for assisting the start of Diesel type internal combustion engines.

2. Prior Art

Electrically energized glow plugs are currently used in compression ignited or Diesel type internal combustion engines to assist in the ignition of the air/fuel mixture during cold starts. In particular glow plugs are essential in the northern states during the winter months when ambient temperatures fall below 10° C.

Currently the glow plugs, such as disclosed by Mann in U.S. Pat. No. 4,281,451, have a coil wire heater enclosed in a protective metal shield. The problem with these glow plugs is that they have a relatively low thermal response time, 15 to 30 seconds, and require relatively large currents, 15 to 25 amps, to bring them up to the required operating temperature. The prior art also teaches replacing the coiled wire heating element with a spiral wound flat tape type heating element as disclosed by Knowles in U.S. Pat. No. 4,297,785. Alternatively Yamamoto et al in U.S. Pat. No. 4,357,526 and Sagawa et al in U.S. Pat. No. 4,035,613 teach a discrete printed circuit heating element imbedded in a ceramic body. However, all of these glow plugs still exhibit the same slow thermal response and relatively high electrical power requirements.

In contrast to the glow plugs described above, Knoll et al in British Patent Application No. 2,092,670-A published Aug. 18, 1982, disclose a glow plug having a layered platinum-rhodium alloy surface film heater element applied to the base of a closed end ceramic tube.

The Applicant in co-pending commonly assigned Patent Application Ser. No. 430,909, filed Sept. 30, 1982 disclosed a similar glow plug having a transition metal surface film heater element circumfrentially coated on a surface of a cylindrical ceramic substrate adjacent to it's end. Tests of the glow plug disclosed in Patent Application Ser. No. 430,909 exhibited improved performance, however, contact corrosion at the opposite ends of the surface film heater element where electrical contact was made to the outer shell and axial electrical terminal were encountered during life tests. The invention is an improved embodiment of the surface film heater type glow plug which is more efficient than the glow plug disclosed by Knoll et al, is easier to make, and solves the contact problems encountered in the former design.

SUMMARY OF THE INVENTION

The invention is a glow plug for an internal combustion engine having a cylindrical metal shell, an axial electrical terminal located concentrically in said shell and electrically insulated therefrom and a surface film heater member electrically connected between the metal shell and the axial electrode. The heater member comprises a cylindrical nonconductive substrate having one end internally captivated between one end of the shell and the axial electrical terminal, and the other end of the heater member protruding externally from the shell. A concentric bore passes through said substrate. A resistive surface film heater element is coated on at least one surface of the substrate adjacent to the external end. A first conductive surface film coated on the external surface of the substrate connects one end of the heater element to the shell. A second conductive surface film coated on at least the internal surface of the substrate connects the other end of the heater element with the axial electrical terminal. Preferably the heater element is a transition metal of the platinum family.

One advantage of the glow plug is that the cylindrical heating element forms a hot cul-de-sac region isolated from the cooling effects of impringing air/fuel mixture and enhances ignition.

Another advantage of the glow plug is that both connections between the heater element, the shell and the axial electrical terminal are made internal to the shell and not exposed to the high temperature and corrosive atmosphere of the engine. Still another advantage of the glow plug is that the heater element is located at the tip of the ceramic substrate minimizing the protrusion needed into the engine's ignition chamber reducing interference of the glow plug with the ignition chamber's air flow pattern. These and other advantages of the improved glow plug will become more apparent from a reading of the specification in conjunction with the drawings.

BRIEF DESCRIPTION OF THE FIGURES

FIG. 4 is an enlarged cross-section of a third embodiment of the heater member.

FIG. 5 is a cross-section showing the glow plug mounted in the swirl chamber of a diesel type internal combustion engine.

DETAILED DESCRIPTION OF THE INVENTION

Figure 1:
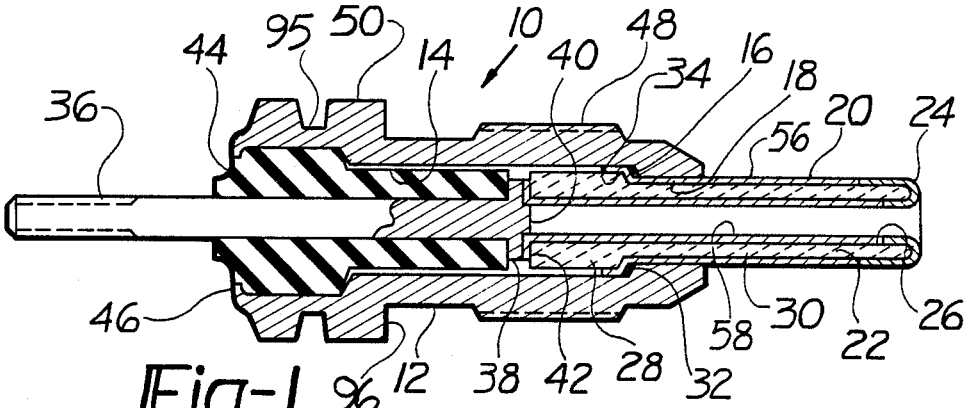
FIG. 1 is a cross section of the improved embodiment of the glow plug.

A cross-sectional view of the glow plug is shown in FIG. 1. The glow plug 10 comprises a cylindrical metal shell 12 having an internal bore 14. Formed at one end of the shell 12 is a contact seat 16 defining a heater aperture 18. Located in the internal bore 14 is a heater member 20 having a resistive surface film heater element 24 coated or disposed on at least one surface of a nonconductive substrate 22 adjacent to one end thereof as shall be described hereinafter. The nonconductive substrate 22 is preferably a high temperature ceramic, but may be quartz, a high temperature glass, or metal sleeve coated with an insulating material. The substrate has an internal bore 26, a base or internal portion 28 disposed in shell 12 and a smaller diameter external portion 30 protruding external to the shell 12 through the heater aperture 18. Heater aperture 18 has a diameter smaller than the diameter of internal portion 28 of the substrate 22 and larger than the diameter of external portion 30.

An axial electrical terminal 36 has a radial flange 38 and guide 40 formed at one end. The guide 40 is received into the internal bore 26 of substrate 22 with one face of the radial flange 38 abutting the internal end face 42 of the substrate 22 with a force sufficient to deform an electrically conductive gasket 32 interposed between a shoulder 34 of the substrate 22 and the shell contact seat 16. The conductive gasket 32 may be copper, gold or any other maleable metal or alloy.

A cylindrical insulator member 44, similar to the insulator commonly used in spark plugs, is inserted in bore 14 circumscribing axial electrical terminal 36 and abutting the opposite face of radial flange 38. The end of the shell 12 is crimped over to form a peripheral lip 46. The insulator member 44, axial electrical terminal 36 and heater member 20 are then locked tightly inside of shell 12 by a hot press operation which heats, then cools and undercut groove 95 while a compressive force is applied between peripheral lip 46 and the opposing end 96 of an external hexagonal portion 50. The shell 12 further includes an externally threaded portion 48 for mounting the glow plug 10 in the engine. The external hexagonal portion 50 facilitates threading the glow plug into an appropriate threaded aperture of the engine.

One advantage of the glow plug shown in FIG. 1 is that the electrical connections between the surface film heater element 24, the shell 12, and the axial electrical terminal 36 are made internal to the shell 12 where they are protected from the high temperatures and corrosive atmosphere inside of the engine. This configuration eliminates the electrical terminal corrosion problems encountered with the prior designs.

Figure 2:
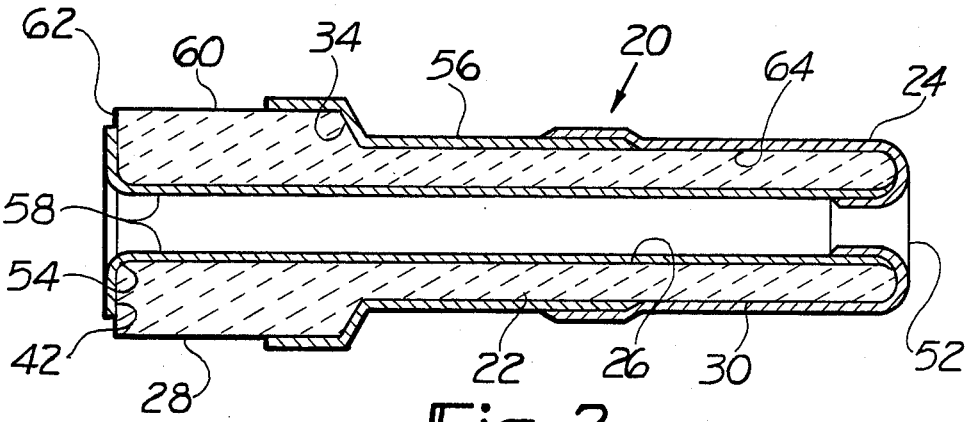
FIG. 2 is an enlarged cross-section showing the details of the heater member.

The details of the heater member 20 are illustrated in FIG. 2. Referring to FIG. 2, the heater member 20, as previously described, has a generally cylindrical substrate 22 having an internal bore 26, an internal portion 28, a smaller diameter external portion 30, and a sloped shoulder 34 connecting the external surfaces of the internal portion 28 and external portion 30. The edges at end face 52 of the substrate 22 are ground to form radii blending the end face 52 with the contiguous internal surface of bore 26 with the external surface of the substrate or may be ground to form a full radius as shown. In a similar manner a ground radius 54 is formed at the base of the substrate blending the end face 42 with the internal surface of bore 26.

A highly conductive metal film 56 is circumferentially coated on the surface of shoulder 34 and a predetermined distance along the external surface of the external portion 30 of the substrate leaving a first uncoated portion 60 adjacent to end face 42 and a second uncoated portion 64 adjacent to end face 52. A similar highly conductive metal film 58, is coated on the internal surface of cylindrical substrate 22 and extends around radius 54 onto end face 42 as shown. The metal film on the end face 42 has a diameter smaller than the diameter of the internal portion 28 leaving an uncoated peripheral portion 62. The highly conductive metal films 56 and 58 may be transition metal films, gold films, alloys thereof or any other metal or metal alloy films.

A resistive metal surface film heater element 24, having a resistance greater than 0.2 ohms is deposited on the uncoated portion 64 of the substrate and on end face 52. Preferably the resistance of heater element 24 is between 0.4 and 0.6 ohms. Heater element 24 and the conductive metal films 56 and 58 overlap providing for electrical contact therebetween. Preferably the resistive metal of heater element 24 is of the platinum family consisting of platinum, rhodium, palladium, iridium and alloys thereof. Alloys having higher melting temperatures, such as alloys containing tungsten and at least one transition metal may be used to increase the operating temperature of the glow plug.

The primary advantage of the cylindrical configuration of the heater member is that the bore 26 form a high temperature cul-de-sac adjacent to its open end which is isolated from the cooling effects of the swirling air/fuel mixture in the engine's ignition chamber. The air/fuel mixture entering the high temperature cul-de-sac formed by bore 26 is more readily ignited than the air/fuel mixture impringing on the external surfaces of the heater member enhancing the ignition efficiency of the glow plug.

In the assembly of the glow plug one end of the heater element 24 is in electrical contact with the shell 12 through surface film 56 on shoulder 34 and electrically conductive gasket 32 while other end of heater element is in electrical contact with axial electrical terminal 36 through surface film 58 on the internal surface of bore 26 and radial flange 38 abutting the extention of surface film 58 onto the end face 42.

Figure 3:
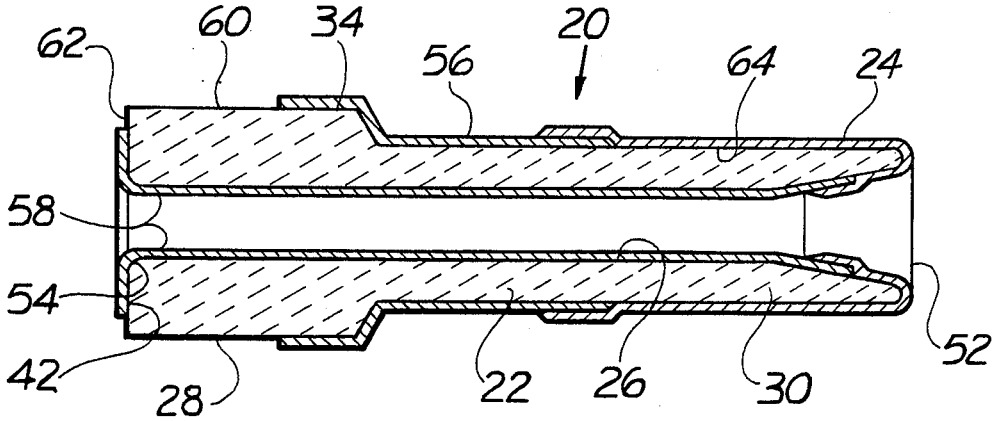
FIG. 3 is an enlarged cross-section of a second embodiment of the heater member.

In an alternate embodiment of the heater member 20 shown in FIG. 3, the bore 26 of the substrate 22 is tapered outwardly at end 52 to enhance the depth at which the heater element 24 may be coated into bore 26. This permits the heater element 24 to wrap around end face 52 and extend a short distance into bore 26 as shown. This further enhances the formation of the high temperature cul-de-sac as previously described.

In contrast to the arrangement shown on FIGS. 2 and 3 the heater element 24 may be coated on the internal surface of the ceramic substrate defined by bore 26 as shown on FIG. 4. In this configuration the conductive metal film 56 extends along the external surface of the substrate adjacent to end face 52. The conductive metal film 58 extends along the internal surface of the substrate and onto end face 42 as in the prior embodiments. This configuration further enhances the high temperature cul-de-sac formed in the bore 26 of ceramic substrate adjacent to the external end face 52.

Because the heater element 24 is located adjacent to the tip of the glow plug, it is no longer required for the glow plug to protrude fully into the ignition chamber of the engine. Referring to FIG. 5 there is illustrated a typical swirl chamber 68 of a diesel type engine having an aperture 70 communicating with the corresponding engine cylinder. As is known in the art, air is pumped in and out of the swirl chamber 68 with the reciprocation of the cylinder's piston as indicated by dashed double headed arrow 72. Fuel from a Fuel Injector 74 is injected into the swirl chamber where it is mixed with the swirling air to form a combustible air/fuel mixture. Because the heater element 24 of the improved glow plug 10 is formed at the tip of the substrate 22, only the tip of the glow plug need to protrude into the swirl chamber 68 as shown. in this way the glow plug 10 produces minimal interference with the swirling air pattern inside of chamber 68. In fact, tests conducted to date indicate efficient ignition of the air fuel mixture can be obtained with the glow plug mounted in the glow plug well 76 with the tip disposed flush with the internal walls of the swirl chamber 68.

The advantages of the improved glow plug are as follows:

1. The low mass of the surface film heater element 24 permits the glow plug to reach an operational temperature above 800° C. in less than 5 seconds.

2. The watt density of the surface film heater element 24 exceeds that of bulk material giving rise to current requirements averaging in the range from 3 to 7 amps at operating temperatures.

3. The transition metal heater element 24 exhibits catalytic action enhancing the ignition of the air/fuel mixture at lower temperatures.

4. The internal surface of the heater member 20 adjacent to external end face 52 remains at the ignition temperature of the air/fuel mixture regardless of the cooling from fuel or air in the ignition chamber.

5. Because the heater element 24 is located at the tip of the glow plug, only the tip of the glow plug needs to protrude into the ignition chamber producing only minimum interference with the ignition chamber's fluid flow pattern.

6. The electrical contacts to the conductive surface films 56 and 58 are made within the shell 12 reducing their exposure to the higher engine temperatures reducing their oxidation and corrosion.

7. The components of the glow plug are applicable to standard spark plug manufacturing techniques and therefore are potentially less costly than glow plugs using spiral wound wire heaters.

It is recognized that the configuration of the various elements of the glow plug may be changed from those shown on the drawings without departing from the spirit of the invention as described herein and set forth in the appended claims.

What is claimed is:

1. A glow plug having a hollow cylindrical metal shell, an axial electrical terminal, insulator means concentrically supporting said electrical terminal in shell and insulating it therefrom, and a heater member electrically connected between the metal shell and the axial electrical terminal characterized by:

a hollow electrically nonconductive cylindrical substrate having an internal surface and an external surface, said cylindrical substrate having an internal portion secured inside the shell between one end of the shell and one end of the electrical terminal and an external portion protruding external from the shell, a resistive surface film disposed on at least one surface of said external portion to form a hollow cylindrical heater element open at the end of said external portion, a first conductive surface film disposed on said external surface of said cylindrical substrate electrically connecting one end of said heater element with the metal shell; and a second conductive surface diposed on at least said internal surface of said cylindrical substrate electrically connecting the other end of said heater element with said electrical terminal.

2. The glow plug of claim 1 wherein said heater element is a metal film having a resistance greater than 0.2 ohms.

3. The glow plug of claim 2 wherein said metal film is a transition metal film selected from the platinum family comprising platinum, palladium, iridium and rhodium.

4. The glow plug of claim 3 wherein said heater element circumscribes said at least one surface of said cylindrical substrate.

5. The glow plug of claim 4 wherein said at least one end surface of said cylindrical substrate on which said heater element is disposed includes the surface of said external portion.

6. The glow plug of claim 4 wherein said heater element is a continuous surface film disposed along said external surface, over the end surface of said external portion and continuing a predetermined distance along said internal surface.

7. The glow plug of claim 4 wherein said heater element is a continuous surface film disposed along said internal surface, over the end surface of said internal portion and continuing a predetermined distance along said external surface.

8. The glow plug of claim 3 wherein said first and second conductive surface films are metal films having a resistance of less than 0.2 ohms.

9. The glow plug of claim 2 wherein said heater element circumscribes said at least one surface of said cylindrical substrate.

10. The glow plug of claim 9 wherein said at least one surface of said cylindrical substrate on which said heater element is disposed includes the end surface of said external portion.

11. The glow plug of claim 9 wherein said heater element is a continuous surface film disposed along said external surface, over the end surface of said external portion and continuing a predetermined distance along said internal surface.

12. The glow plug of claim 9 wherein said heater element is a continuous surface film disposed along said internal surface, over the end surface of said external portion and continuing a predetermined distance along said external surface.

13. The glow plug of claim 1 wherein said heater element is a metal film having a resistance between 0.4 and 0.6 ohms.

14. The glow plug of claim 1 wherein said heater element is a metal alloy film having a resistance greater than 0.2 ohms.

15. The glow plug of claim 14 wherein said metal alloy film has at least one constituent selected from the platinum family comprising platinum, palladium, iridium and rhodium.

16. The glow plug of claim 1 wherein said first and second conductive surface films have a resistance of less than 0.2 ohms.

17. The glow plug of claim 1 wherein said cylindrical substrate is a ceramic substrate.

18. A glow plug for an internal combustion engine comprising:

a metal shell having a cylindrical cavity passing therethrough, a peripheral seat formed at one end of said cylindrical cavity defining a heater member aperture, and a lip partially enclosing the other end;

an electrically nonconductive cylindrical substrate having an internal portion at one end disposed in said cylindrical cavity, a smaller diameter external portion at the opposite end protruding external from said shell through said heater member aperture, a shoulder connecting said internal and external portions, and a concentric bore passing therethrough;

an axial electrical terminal disposed in said shell, said electrical terminal having a radial flange abutting said one end of said cylindrical substrate:

insulator means for concentrically supporting said electrical terminal in said shell, said insulator means secured in said shell by said lip and producing a force on said electrical terminal urging the shoulder of said cylindrical substrate to abut against said peripheral seat fixedly locking said cylindrical substrate therebetween;

a resistive surface film heater element disposed on at least one surface of said cylindrical substrate adjacent to said opposite end;

a first conductive surface film disposed on the external surface of said cylindrical substrate electrically connecting one end of said heater element with said shell in the area where said shoulder abuts said peripheral seat; and a second conductive surface film disposed on the internal surface of said cylindrical substrate and a portion of said one end of said substrate electrically connecting the other end of said heater element with said electrical terminal in the area where said radial flange abuts said one end.

19. The glow plug of claim 18 wherein said glow plug further includes a deformable electrically conductive gasket between the shoulder of said cylindrical substrate and said peripheral seat to facilitate electrical connection between said first conductive film and said shell.

20. The flow plug of claim 19 wherein said deformable conductive gasket is a copper gasket.

21. The glow plug of claim 18 wherein said metal shell further includes an external threaded portion threadibly received in the engine and an external hexagonal portion to facilitate threading the glow plug into the engine.

22. The glow plug of claim 18 wherein said cylindrical substrate is a ceramic substrate.

23. The glow plug of claim 18 wherein said surface film heater element is a metal film having a resistance greater than 0.2 ohms.

24. The glow plug of claim 23 wherein said first and second conductive surface films have has a resistance less than 0.2 ohms.

25. The glow plug of claim 24 wherein said heater element is a metal film having a resistance between 0.4 and 0.6 ohms.

26. The glow plug of claim 23 wherein said surface film heater element is a transition metal film selected from the platinum family comprising platinum, palladium, iridium and rhodium.

27. The glow plug of claim 23 wherein said heater element circumscribes said at least one surface of said cylindrical substrate.

28. The glow plug of claim 27 wherein said at least one surface of said cylindrical substrate on which said heater element is disposed includes the surface of said opposite end.

29. The glow plug of claim 27 wherein said heater element is a continuous metal film disposed along the external surface of said substrate, over the end surface of said external portion and continuing a predetermined distance along the internal surface of said substrate.

30. The glow plug of claim 27 wherein said heater element is a continuous metal film disposed along the internal surface of said substrate, over the end surface of said external portion and continuing a predetermined distance along the external surface of said substrate.

31. The glow plug of claim 18 wherein said heater element is a metal alloy film having a resistance greater than 0.2 ohms.

32. The glow plug of claim 31 wherein said heater element said at least one surface of said cylindrical substrate.

33. The glow plug of claim 32 wherein said at least one surface of said cylindrical substrate on which said heater element is disposed includes the surface of said opposite end.

34. The glow plug of claim 32 wherein said heater element is a continuous metal film disposed along the external surface of said substrate, over the end surface of said external portion and continuing a predetermined distance along the internal surface of said substrate.

35. The glow plug of claim 32 wherein said heater element is a continuous metal film disposed along the internal surface of said substrate, over the end surface of said external portion and continuing a predetermined distance along the external surface of said substrate.

36. The glow plug of claim 31 wherein said metal alloy film has at least one constituent selected from the platinum family comprising platinum, palladium, iridium and rhodium.

37. The glow plug of claim 18 wherein said first and second conductive surface films have a resistance of less than 0.2 ohms.

38. A heater for igniting hydrocarbon fuels comprising:

a metal shell having a cylindrical cavity passing therethrough, a peripheral seat formed at one end of said cylindrical cavity defining a heater member aperture, and a lip partially enclosing the other end;

an electrically nonconductive cylindrical substrate having an internal portion at one end disposed in said cylindrical cavity, a smaller diameter external portion at the opposite end protruding external from said shell through said heater member aperture, a shoulder connecting said internal and external portions, and a concentric bore passing therethrough;

an axial electrical terminal disposed in said shell, said electrical terminal having a radial flange abutting said one end of said cylindrical substrate:

insulator means for concentrically supporting said electrical terminal in said shell, said insulator means secured in said shell by said lip at the other end of said shell and producing a force on said electrical terminal urging the shoulder of said cylindrical substrate to abut against said peripheral seat fixedly locking said cylindrical substrate therebetween;

a resistive surface film heater element having a first predetermined resistance disposed on at least one surface of said cylindrical substrate ajacent to said opposite end;

a first conductive surface film having a second predetermined resistance lower than said first predetermined resistance disposed on the external surface of said cylindrical substrate electrically connecting one end of said heater element with said shell in the area where said shoulder abuts said peripheral seat; and a second conductive surface film having a third predetermined resistance lower than said first predetermined resistance disposed on the internal surface of said cylindrical substrate and a portion of said one end of said substrate electrically connecting the other end of said heater element with said electrical terminal in the area where said radial flange abus said one end.

39. The heater of claim 38 having a deformable electrically conductive gasket between the shoulder of said cylindrical substrate and said peripheral seat to facilitate electrical connection between said first conductive film and said shell.

40. The heater of claim 38 wherein said cylindrical substrate is a ceramic substrate.

41. The heater of claim 38 wherein said surface film heater element is a transition metal film selected from the plantinum family comprising platinum, palladium, iridium and rhodium.

42. The heater of claim 38 wherein said heater element is a metal alloy film.

43. The heater of claim 42 wherein said metal alloy film has at least one constituent selected from the platinum family comprising platinum, palladium, iridium and rhoidum.

44. The heater of claim 38 wherein said heater element circumscribis said at least one surface of said cylindrical substrate.

45. The heater of claim 38 wherein said heater element is continuous metal film disposed along the external surface of the substrate, over the end surface of said external portion and continuing along the internal surface of said substrate.

46. In a glow plug of the type having a cylindrical metal shell, an axial electrode, an insulator securing the axial electrode in said metal shell and electrically insulating it therefrom, and a heater member electrically connected between the metal shell and the axial electrode, said heater element characterized by:

a cylindrical, electrically nonconductive substrate having internal, external and end surfaces, said substrate having an internal portion disposed in the shell at one end thereof and secured therein by said axial electrode engaging one end thereof, and an external portion protruding external to the shell; and a continuous resistive surface film heater element disposed on said internal and external surfaces of said cylindrical substrate and on the end surface of said external portion electrically connecting the portions of said heater element disposed on said internal and external surfaces, the portion of said heater element disposed on the internal surface electrically connected to the axial electrode and the portion of said heater element disposed on said external surface electrically connected to said metal shell.

47. The glow plug of claim 46 wherein said heater element is a transition metal film selected from the platinum family comprising platinum, palladium, iridium and rhodium.

48. The glow plug of claim 46 wherein said heater element is a metal alloy having at least one constituent selected from the platinum family comprising platinum, palladium, iridium and rhodium.

49. The glow plug of claim 46 wherein said substrate is a ceramic substrate.

50. A glow plug comprising:

a metal shell defining a cylindrical internal chamber having a heater aperture at one end thereof;

a cylindrical, electrically nonconductive substrate having internal, external and end surfaces, said substrate having a first portion disposed in said internal chamber adjacent to said heater aperture and a second portion extending axially through said heater aperture external to said shell;

a layer of resistive material disposed on said internal and external surfaces and around the end of said second portion electrically connecting the layers of resistive material disposed on said internal and external surfaces to form a continuous resistive heater element, the layer of resistive material disposed on the external surface of said substrate being in electrical contact with said shell;

an axial electrode disposed in said shell, said axial electrode engaging the end surface of the first portion of said cylindrical substrate and electrically connected to the layer of resistive material disposed on the internal surface of the cylindrical substrate; and insulator means securing said axial electrode in said shell and locking said cylindrical substrate between said axial electrode and said one end of said shell.

51. The glow plug of claim 50 wherein said cylindrical substrate is a ceramic substrate.

52. The glow plug of claim 50 wherein said layer of resistive material is a thin layer of a transition metal selected from the platinum family comprising platinum, palladium, iridium and rhodium.

53. The glow plug of claim 50 wherein said layer of resistive material is a thin layer of a metal alloy having, as one of its constituents, a transition metal selected from the platinum family comprising platinum, palladium, iridium and rhodium.

* * * * *